US010083659B2

(12) United States Patent
Xiang et al.

(10) Patent No.: US 10,083,659 B2
(45) Date of Patent: Sep. 25, 2018

(54) ORGANIC LIGHT EMITTING DISPLAY PANEL, DRIVING METHOD THEREOF AND ORGANIC LIGHT EMITTING DISPLAY APPARATUS

(71) Applicant: SHANGHAI TIANMA AM-OLED CO., LTD., Shanghai (CN)

(72) Inventors: Dongxu Xiang, Shanghai (CN); Yue Li, Shanghai (CN); Renyuan Zhu, Shanghai (CN); Tong Wu, Shanghai (CN); Dong Qian, Shanghai (CN); Zeyuan Chen, Shanghai (CN); Gang Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/629,590

(22) Filed: Jun. 21, 2017

(65) Prior Publication Data

US 2017/0287403 A1 Oct. 5, 2017

(30) Foreign Application Priority Data

Jan. 25, 2017 (CN) ..... 2017 1 0056070

(51) Int. Cl.
*G09G 3/3258* (2016.01)
*G09G 3/3233* (2016.01)
*G09G 3/32* (2016.01)

(52) U.S. Cl.
CPC ..... *G09G 3/3258* (2013.01); *G09G 3/32* (2013.01); *G09G 3/3233* (2013.01); *G09G 2300/0861* (2013.01); *G09G 2310/0251* (2013.01); *G09G 2320/0626* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,638,276 | B2 * | 1/2014 | Lee | G09G 3/3291 345/76 |
| 9,001,105 | B2 * | 4/2015 | Han | G09G 3/3233 345/211 |
| 9,183,778 | B2 * | 11/2015 | Lee | G09G 3/003 |
| 9,666,137 | B2 * | 5/2017 | Barnhoefer | G09G 3/3275 |
| 9,911,385 | B2 * | 3/2018 | Lee | G09G 3/3291 |
| 2008/0088548 | A1 * | 4/2008 | Lee | G09G 3/3225 345/77 |

* cited by examiner

*Primary Examiner* — Van Nguyen Chow
(74) *Attorney, Agent, or Firm* — Alston & Bird LLP

(57) ABSTRACT

The present application discloses an organic light emitting display panel, a driving method thereof and an organic light emitting display apparatus. The organic light emitting display panel comprises: a pixel array, comprising pixel regions in M rows and N columns; a plurality of pixel driving circuits each comprising a light emitting diode and a driving transistor for driving the light emitting diode, the light emitting diode being arranged in one of the pixel regions; and a plurality of pixel compensation circuits, each configured to provide a compensated light emitting control signal for a gate of the driving transistor to correct brightness of the light emitting diode in one of the plurality of pixel driving circuits. According to the present disclosure, the final light emitting current may be unrelated to the threshold voltage of the driving transistor, the carrier mobility and aging of the light emitting diode.

11 Claims, 10 Drawing Sheets

ORGANIC LIGHT EMITTING DISPLAY PANEL, DRIVING METHOD THEREOF AND ORGANIC LIGHT EMITTING DISPLAY APPARATUS

CROSS-REFERENCE TO RELATED APPLICATION

This application is related to and claims priority from Chinese Patent Application No. CN201710056070.2, filed on Jan. 25, 2017, entitled "Organic Light Emitting Display Panel, Driving Method Thereof, and Organic Light Emitting Display Apparatus," the entire disclosure of which is hereby incorporated by reference for all purposes.

TECHNICAL FIELD

The present disclosure generally relates to the field of display technologies, and more particularly, to an organic light emitting display panel, a driving method thereof and an organic light emitting display apparatus.

BACKGROUND

With the continuous development of display technologies, dimensions of displays change with each passing day. To meet portability of electronic devices, the demand for display screens with smaller dimensions is ever-increasing.

Meanwhile, users put forward higher requirements for the display quality of the display screens. For example, the users are apt to prefer display screens with high Pixels per Inch (PPI) to improve display accuracy, resolution, and coherence.

An organic light emitting diode (OLED) display is more widely used in various portable electronic devices because of its slim and flexible shape, light weight, and power saving features, etc.

The OLED display generally includes an OLED array (namely, a pixel array), driving circuits (namely, pixel circuits) configured to provide driving current for each OLED in the array, and scanning circuits configured to provide drive signals for each pixel circuit.

However, in existing OLED displays, generally, pixel circuits only compensate threshold voltages (Vth) of driving transistors, but no consideration is given to problems of carrier mobility of the driving transistors and aging of light emitting components with the accumulation of service time. For example, as time goes on, when current flows through the light emitting components, forward voltage drop (minimum forward voltage at which the light emitting components can be turned on under assigned forward current) of the light emitting components increases, and the light emitting components generally connect sources/drains of the driving transistors. Therefore, the source to drain voltage difference of the driving transistor diminishes, which may reduce the light emitting current flowing through the light emitting components. However, a plurality of light emitting components and driving transistors are present in the OLED displays, aging degree of each light emitting component and variation degree of the carrier mobility of the driving transistors are different, as a result these light emitting components become different in display brightness even though the same display signal is provided to each pixel circuit, and further cause deterioration of display uniformity of the OLED displays.

SUMMARY

It is desired to provide an organic light emitting display panel, a driving method thereof and an organic light emitting display apparatus, in order to solve the technical problem mentioned above.

In a first aspect, an embodiment of the present disclosure provides an organic light emitting display panel. The organic light emitting display panel includes: a pixel array, a plurality of pixel driving circuits, and a plurality of pixel compensation circuits. The pixel array includes pixel regions in M rows and N columns. The plurality of pixel driving circuits each includes a light emitting diode and a driving transistor for driving the light emitting diode. The light emitting diode is arranged in the pixel region. The plurality of pixel compensation circuits are configured to provide a compensated light emitting control signal for a gate of the driving transistor to correct brightness of the light emitting diodes. The pixel compensation circuit includes a current source, a first transistor, a second transistor and a third transistor. A gate of the first transistor and a gate of the second transistor are electrically connected with a first control signal terminal. A first electrode of the first transistor and a first electrode of the second transistor are electrically connected with an output terminal of the current source. A second electrode of the first transistor is electrically connected with the gate of the driving transistor. A second electrode of the second transistor is electrically connected with a second electrode of the third transistor. A gate of the third transistor is electrically connected with a second control signal terminal. A first electrode of the third transistor is electrically connected with a first voltage signal terminal. A second electrode of the third transistor is electrically connected with a first electrode of the driving transistor. The pixel driving circuit further includes a first capacitor. A first end of the first capacitor is electrically connected with the gate of the driving transistor. A second end of the first capacitor is electrically connected with a second electrode of the driving transistor and an anode of the light emitting diode.

In a second aspect, an embodiment of the present disclosure provides a driving method applicable to the above organic light emitting display panel. The driving method comprises: in a data writing phase, providing a first level signal for a first control signal terminal, and providing a second level signal for a second control signal terminal to provide a data current signal outputted from a current source for a driving transistor; and in a light emission phase, providing the second level signal for the first control signal terminal, and providing the first level signal for the second control signal terminal, to enable the light emitting diode to emit light.

In a third aspect, an embodiment of the present disclosure provides a driving method applicable to the above organic light emitting display panel. In the organic light emitting display panel, the pixel compensation circuit further comprises a second acquisition capacitor, a third acquisition capacitor, a fourth transistor and a fifth transistor; a first end of the third acquisition capacitor is electrically connected with the second electrode of the first transistor, and a second end of the third acquisition capacitor is grounded. A gate of the fourth transistor is electrically connected with a fourth control signal terminal. A first electrode of the fourth transistor is electrically connected with a first end of the second acquisition capacitor. A second electrode of the fourth transistor is electrically connected with a reference voltage signal line. A gate of the fifth transistor is electrically connected with a fifth control signal terminal. A first electrode of the fifth transistor is electrically connected with a data line. A second electrode of the fifth transistor is electrically connected with the second electrode of the first transistor. The method comprises: in an initialization phase, providing a first level signal for the first control signal terminal, and providing a second level signal for the second control signal terminal, the fourth control signal terminal and the fifth control signal terminal, to provide an initial current signal for the gate of the driving transistor and the anode of the light emitting diode; in a voltage acquisition phase, providing the second level signal for the first control signal terminal and the second control signal terminal, and providing the first level signal for the fourth control signal terminal and the fifth control signal terminal, to receive a gate voltage of the driving transistor acquired by the third acquisition capacitor and an anode voltage of the light emitting diode acquired by the second acquisition capacitor; in a data writing phase, providing the second level signal for the first control signal terminal and the second control signal terminal, and providing the first level signal for the fourth control signal terminal and the fifth control signal terminal, to provide a compensated data voltage signal for the gate of the driving transistor, wherein the compensated data voltage signal is generated based on the gate voltage of the driving transistor acquired by the third acquisition capacitor and the anode voltage of the light emitting diode acquired by the second acquisition capacitor; and in a light emission phase, providing the second level signal for the first control signal terminal, the fourth control signal terminal and the fifth control signal terminal, and providing the first level signal for the second control signal terminal, to enable the light emitting diode to emit light based on the compensated data voltage signal.

In a fourth aspect, an embodiment of the present disclosure provides an organic light emitting display apparatus. The organic light emitting display includes the above organic light emitting display panel.

According to the solution of the present disclosure, final light emitting current may be unrelated to threshold voltage of the driving transistor, carrier mobility and aging of the light emitting diode, thereby ensuring display brightness uniformity for the organic light emitting display panel in time dimension and space dimension.

BRIEF DESCRIPTION OF THE DRAWINGS

Other features, objectives and advantages of the present disclosure will become more apparent upon reading the detailed description to non-limiting embodiments with reference to the accompanying drawings.

DETAILED DESCRIPTION OF EMBODIMENTS

The present disclosure will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the invention are shown in the accompanying drawings.

It should also be noted that the embodiments in the present disclosure and the features in the embodiments may be combined with each other on a non-conflict basis. The present disclosure will be described below in detail with reference to the accompanying drawings and in combination with the embodiments.

Figure 1:
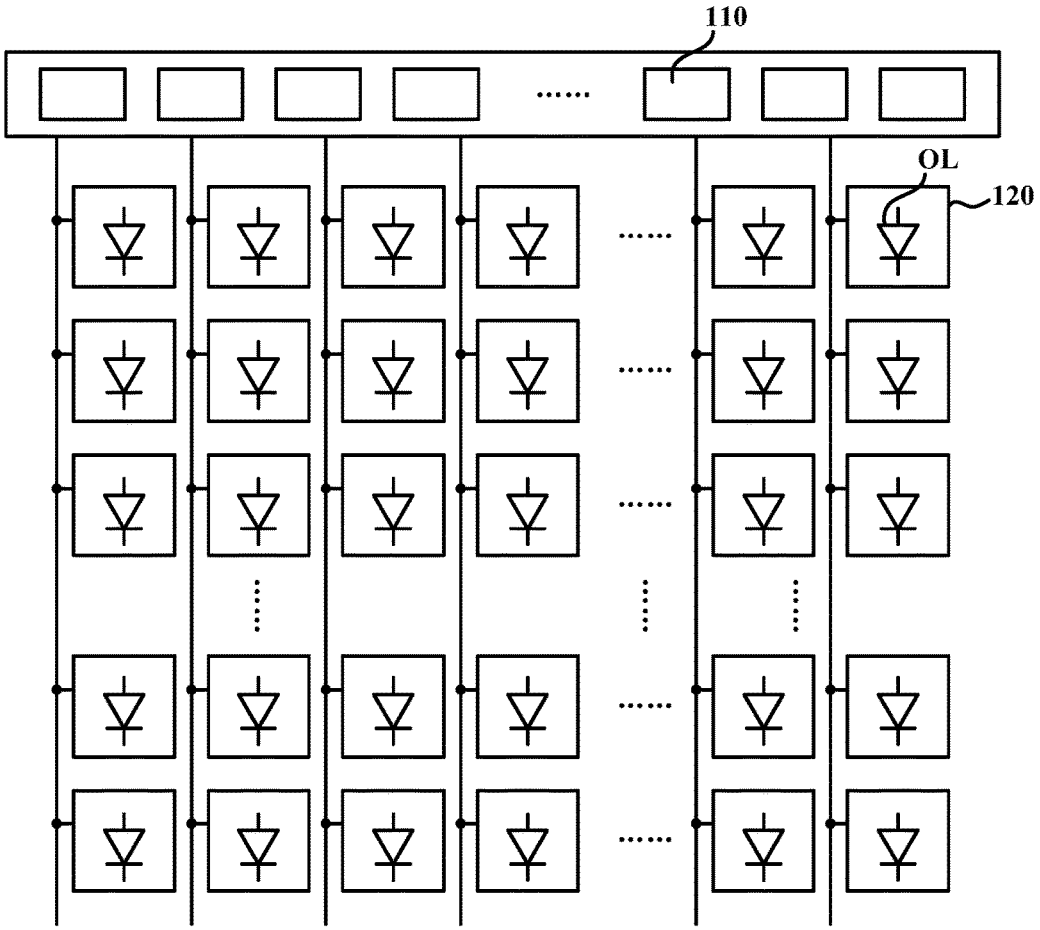
FIG. 1 illustrates a schematic structural diagram of an organic light emitting display panel according to an embodiment of this application.

Referring to FIG. 1, which is a schematic structural diagram of an organic light emitting display panel according to an embodiment of the present disclosure.

The organic light emitting display panel of this embodiment comprises a pixel array, a plurality of pixel driving circuits (not shown in the figure) and a plurality of pixel compensation circuits 110.

The pixel array comprises pixel regions 120 in M rows and N columns. Each pixel driving circuit may comprise a light emitting diode OL and a driving transistor (not shown in the figure) configured to drive the light emitting diode OL. One light emitting diode is arranged in each pixel region 120. In some optional implementations, the pixel driving circuit may be arranged in each pixel region 110. The light emitting diodes in the corresponding pixel region 110 may display corresponding brightness by controlling on or off of the driving transistors in the pixel region 110.

The pixel compensation circuit 110 may be configured to provide a compensated light emitting control signal for a gate of the driving transistor to correct brightness of each light emitting diode OL.

In the following, the principle of the pixel compensation circuit of this embodiment will be described in combination with FIG. 2.

Figure 2:
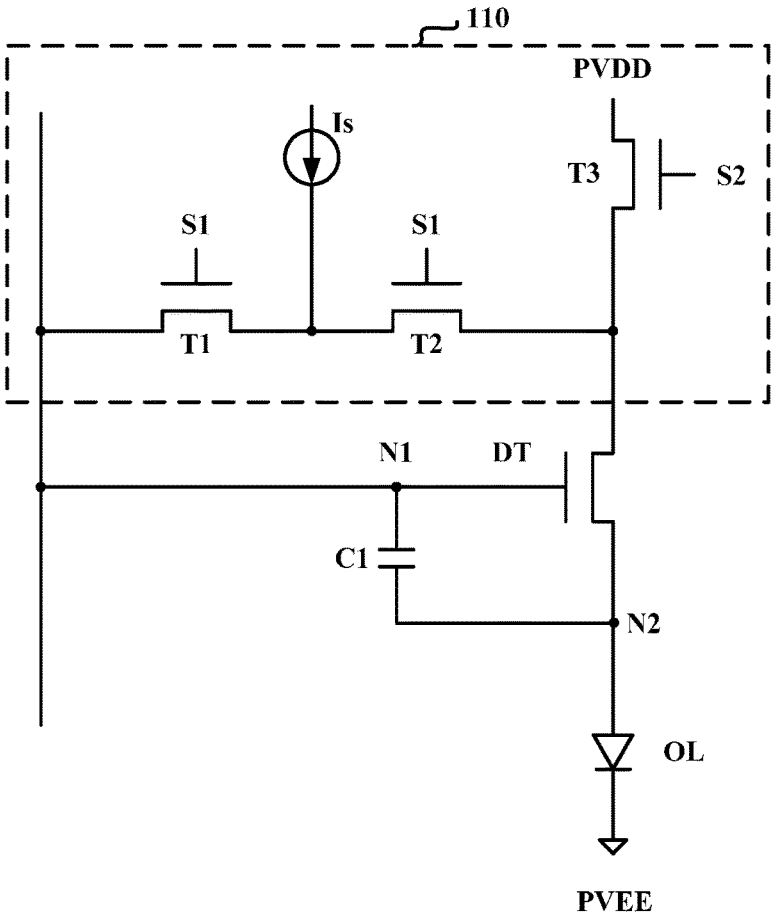
FIG. 2 illustrates a schematic diagram of a connection relationship between a pixel driving circuit and a pixel compensation circuit in an organic light emitting display panel according to an embodiment of the present disclosure.

FIG. 2 illustrates a schematic diagram of a connection relationship between a pixel driving circuit and a pixel compensation circuit in an organic light emitting display panel according to an embodiment of the present disclosure.

In FIG. 2, the pixel compensation circuit comprises a current source Is, a first transistor T1, a second transistor T2 and a third transistor T3. A gate of the first transistor T1 and a gate of the second transistor T2 are electrically connected with a first control signal terminal S1. A first electrode of the first transistor T1 and a first electrode of the second transistor T2 are electrically connected with an output terminal of the current source Is. A second electrode of the first transistor T1 is electrically connected with the gate (a node N1) of the driving transistor DT, and a second electrode of the second transistor T2 is electrically connected with a second electrode of the third transistor T3. A gate of the third transistor T3 is electrically connected with the second control signal terminal S2, a first electrode of the third transistor T3 is electrically connected with a first voltage signal terminal PVDD, and a second electrode of the third transistor T3 is electrically connected with a first electrode of the driving transistor DT. In addition, as shown in FIG. 2, the second electrode (a node N2) of the driving transistor DT is electrically connected with an anode of the light emitting diode OL, and a cathode of the light emitting diode OL is electrically connected with a second voltage signal terminal PVEE. The pixel driving circuit further comprises a first capacitor C1, a first end of the first capacitor C1 is electrically connected with the gate of the driving transistor DT, and a second end of the first capacitor C1 is electrically connected with a second electrode of the driving transistor DT and the anode of the light emitting diode OL.

In this way, current generated by the current source Is may be supplied to the node N1 and the node N2 by controlling a control signal of the first control signal terminal S1 and the second control signal terminal S2. In addition, the light emitting diode OL may be controlled to emit light by controlling the control signal of the second control signal terminal S2. Current generated by the current source Is may be directly supplied to the node N1 and the node N2, and voltages of the node N1 and the node N2 are fixed in the phase of writing the data voltage signal by means of the current source Is. Furthermore, the first capacitor C1 is connected between the node N1 and the node N2, based on a coupling action of the capacitor, in the light emission phase, the voltage of the node N1 synchronizes with the voltage of the node N2. Therefore, the voltage difference between the node N1 and the node N2 remains unchanged. As can be seen from the above analysis, as long as the current source Is supplies light emitting current corresponding to each display gray scale to each pixel driving circuit via the pixel compensation circuit 110, the light emitting diode OL in each pixel driving circuit may be ensured to emit light of corresponding brightness, and the light emitting brightness may be merely related to the magnitude of the light emitting current supplied by the current source but unrelated to the threshold voltage of the driving transistor DT, the carrier mobility and the aging degree of the light emitting diode OL (namely, the I-V curve of the light emitting diode OL), wherein the I-V curve is the volt-ampere characteristic curve, where I is the light emitting current, and V is the anode voltage.

Figure 3:
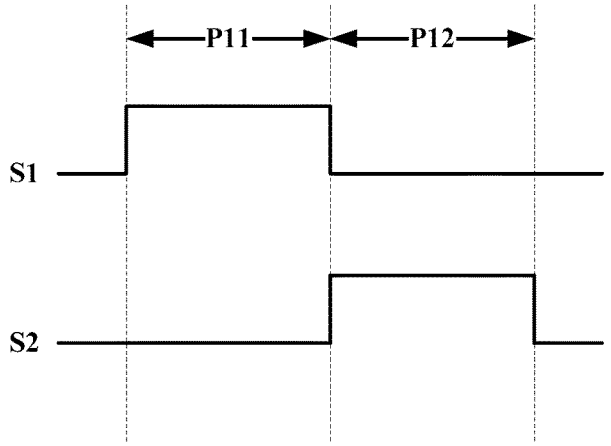
FIG. 3 illustrates a schematic timing sequence of each drive signal used in FIG. 2.

In the following, assume, as an example, each transistor is an NMOS transistor, the working principle of the pixel compensation circuit of this embodiment is further schematically described in combination with the driving time sequence as shown in FIG. 3, so as to highlight technical effects of the pixel compensation circuit of this embodiment.

Specifically, in a data writing phase P11, the current source Is outputs light emitting current corresponding to display brightness according to the display brightness required for a current display picture. At this moment, to supply the light emitting current to the node N1 and the node N2, the first control signal terminal S1 provides a high level signal while the second control signal terminal S2 provides a low level signal. Thus, both the first transistor T1 and the second transistor T2 are turned on under the control of the high voltage level signal, and a light emitting current signal is supplied to the node N1 and the node N2 respectively via the first transistor T1 and the second transistor T2. After stabilization, no current flows through the node N1. At this moment, light emitting current outputted by the current source is totally supplied to the node N2, and voltages of the node N1 and the node N2 are fixed.

Next, in a light emission phase P12, the first control signal terminal S1 provides a low voltage level signal while the second control signal terminal S2 provides a high level signal. As thus, both the first transistor T1 and the second transistor T2 are turned off under the control of the low voltage level signal, and the third transistor T3 is turned on under the control of the high voltage level signal. As the light emitting current flows to the light emitting diode OL, the voltage of the node N2 may be further pulled up under the action of the first voltage signal VDD provided by the first voltage signal terminal PVDD. Meanwhile, the node N1 is in a suspension state because the first transistor T1 is turned off. Under the coupling action of the first capacitor C1, the voltage of the node N1 will synchronously vary with the voltage of the node N2, so that the voltage difference between the node N1 and the node N2 remains unchanged. In this way, it is ensured that the light emitting current is stable and the brightness of the light emitting diode OL maintains constant.

As can be seen from the above description, in this embodiment, as long as the current source Is supplies light emitting current corresponding to each display gray scale to each pixel driving circuit via the pixel compensation circuit 110, the light emitting diode OL in each pixel driving circuit may be ensured to emit light of corresponding brightness, and the light emitting brightness may be merely related to the magnitude of the light emitting current supplied by the current source but unrelated to the threshold voltage of the driving transistor DT, the carrier mobility and the aging degree of the light emitting diode OL (namely, the I-V ratio of the light emitting diode OL). Therefore, no matter how the threshold voltage of each driving transistor DT in the organic light emitting display panel and the carrier mobility vary, and no matter what the aging degree of each light emitting diode OL in the organic light emitting display panel is, by using the pixel compensation circuit of this embodiment, uniform display of each display brightness in each region of the organic light emitting display panel may be implemented, thereby enhancing the display brightness uniformity for the organic light emitting display panel.

In addition, in some optional implementations, to avoid the light emitting diode OL from being lighted in the above-described data writing phase P11, in the data writing phase P11, a higher voltage signal may be supplied to the second voltage signal terminal PVEE connected with the cathode of the light emitting diode OL, so as to prevent the light emitting diode OL from being turned on in this phase.

Figure 4:
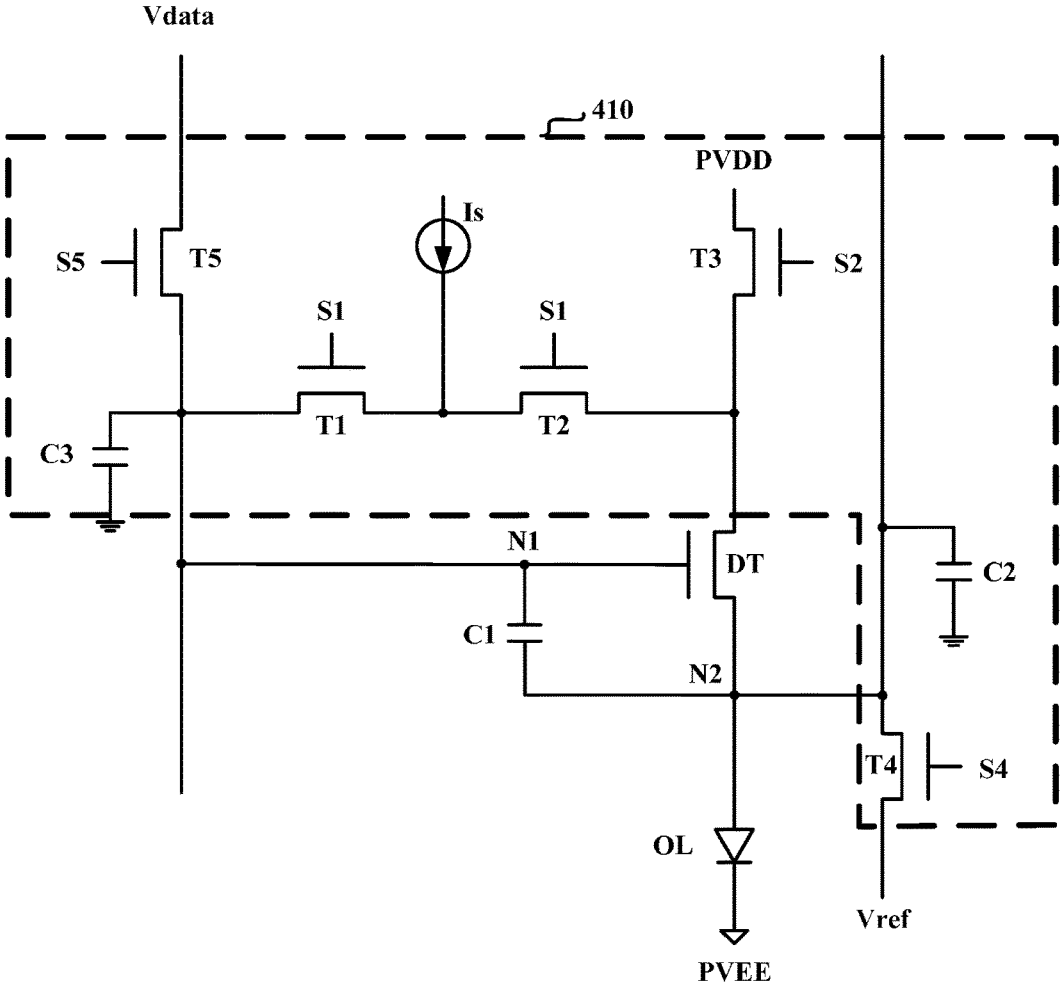
FIG. 4 illustrates a schematic diagram of a connection relationship between a pixel driving circuit and a pixel compensation circuit in an organic light emitting display panel according to another embodiment of the present disclosure.

Referring to FIG. 4, which illustrates a schematic diagram of a connection relationship between a pixel driving circuit and a pixel compensation circuit in an organic light emitting display panel according to another embodiment of the present disclosure.

Similar to the embodiment as shown FIG. 2, in this embodiment, the pixel driving circuit likewise comprises the driving transistor DT, the light emitting diode OL and the first capacitor C1. The pixel compensation circuit 410 likewise comprises the current source Is, the first transistor T1, the second transistor T2 and the third transistor T3. The connection relationship among these components is similar to the embodiment as shown in FIG. 2.

Different from the embodiment as shown in FIG. 2, in this embodiment, the pixel compensation circuit 410 further comprises a second acquisition capacitor C2, a third acquisition capacitor C3, a fourth transistor T4 and a fifth transistor T5.

A first end of the third acquisition capacitor C3 is electrically connected with the second electrode of the first transistor T1, and a second end of the third acquisition capacitor C3 is grounded.

A gate of the fourth transistor T4 is electrically connected with a fourth control signal terminal S4, a first electrode of the fourth transistor T4 is electrically connected with a first end of the second acquisition capacitor C2, a second electrode of the fourth transistor T4 is electrically connected with a reference voltage signal line, and a second end of the second acquisition capacitor C2 is grounded.

A gate of the fifth transistor T5 is electrically connected with a fifth control signal terminal S5, a first electrode of the fifth transistor T5 is electrically connected with a data line Vdata, and a second electrode of the fifth transistor T5 is electrically connected with the second electrode of the first transistor T1.

As thus, the current source Is of the pixel compensation circuit 410 may output a reference current signal to the node N1 and the node N2 of the pixel driving circuit. The voltage of the node N1 is acquired by the third acquisition capacitor C3, and the voltage of the node N2 is acquired by the second acquisition capacitor C2. A certain numerical relationship exists among the light emitting current, the difference Vgs between the gate voltage (namely, the voltage of the node N1) and the source voltage (namely, the voltage of the node N2) of the driving transistor DT, the carrier mobility of the driving transistor DT and the threshold voltage of the driving transistor DT, and the reference current signal outputted by the current source Is is a known numerical value. Therefore, by repeatedly acquiring the voltage of the node N1 and the voltage of the node N2, the carrier mobility and the threshold voltage of the driving transistor DT may be determined correspondingly. Meanwhile, the I (flow current)-V (anode voltage) ratio of the light emitting diode OL may be worked out by means of the voltage of the node N2 and the reference current signal outputted by the current source Is.

As can be seen from the above analysis, by acquiring the gate voltage (the voltage of the node N1) of the driving transistor DT and the anode voltage (the voltage of the node N2) of the light emitting diode OL, the pixel compensation circuit 410 may determine the current carrier mobility and the threshold voltage of the driving transistor DT and the I-V ratio of the light emitting diode OL in the pixel driving circuit in the event that the light emitting current (namely, the reference current outputted by the current source Is) flowing through the light emitting diode OL is known. As thus, a compensation signal may be determined according to the gate voltage (the voltage of the node N1) of the driving transistor DT, the anode voltage of the light emitting diode OL and the known light emitting current (namely, the reference current outputted by the current source Is) flowing through the light emitting diode OL. When a data voltage signal is applied to each pixel driving circuit, the data voltage signal applied to each pixel driving circuit is compensated by using the compensation signal, so as to enhance the display brightness uniformity for the whole organic light emitting display panel.

Figure 5:
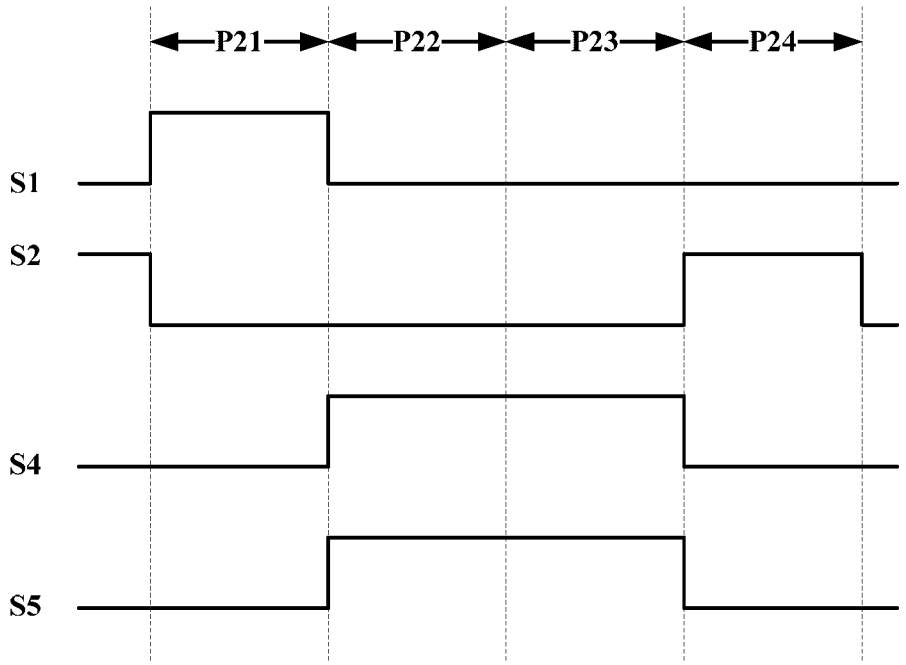
FIG. 5 illustrates a schematic timing sequence of each drive signal used in FIG. 4.

In the following, the working principle of the pixel compensation circuit in this embodiment will be further described with reference to the timing diagram as shown in FIG. 5. In the following description, a description is schematically made taking each transistor in FIG. 4 as an NMOS transistor.

Specifically, in a precharge phase P21, the first control signal terminal S1 inputs a high voltage level signal, and the second control signal terminal S2, the fourth control signal terminal S4 and the fifth control signal terminal S5 input a low voltage level signal. At this moment, the first transistor T1 and the second transistor T2 are turned on, the current source Is outputs a known reference current signal and supplies the reference current signal to the gate of the driving transistor DT and the anode of the light emitting diode OL. After the second acquisition capacitor C2 and the third acquisition capacitor C3 are continuously charged, after stabilization, no current flows through the gate of the driving transistor DT. At this moment, the reference current signal outputted by the current source Is totally flows to the anode (node N2) of the light emitting diode OL.

Next, in a voltage acquisition phase P22, the first control signal terminal S1 and the second control signal terminal S2 input a low voltage level signal, and the fourth control signal terminal S4 and the fifth control signal terminal S5 input a high voltage level signal. At this moment, the fourth transistor T4 and the fifth transistor T5 are turned on. As thus, the voltage VN1 of the node N1 stored in the third acquisition capacitor C3 in the precharge phase P21 may be acquired via a data line Vdata, and the voltage VN2 of the node N2 stored in the second acquisition capacitor C2 in the precharge phase P21 may be acquired via the reference voltage signal line Vref.

When the driving transistor DT is in a saturation region, current Ids may be determined according to following Formula (1):

$$Ids=\tfrac{1}{2}\mu C_{ox}W/L(Vgs-|Vth|)^2 \quad (1),$$

wherein μ is the carrier mobility of the driving transistor DT;

$C_{ox}$ is a capacitance value of a gate oxide layer capacitor per unit area of the driving transistor DT, which is a fixed value;

Vgs is a difference between the gate voltage Vg (namely, the voltage VN1 of the node N1) of the driving transistor DT and a source voltage Vs (namely, the voltage VN2 of the node N2);

W/L is a width-to-length ratio of the driving transistor DT, which is a fixed value; and Vth is the threshold voltage of the driving transistor DT.

In the precharge phase, the current outputted by the current source Is is a known quantity, in the above Formula (1), Ids, Cox, and Vgs=VN1−VN2 are known. Unknown quantities comprise the carrier mobility μ of the driving transistor DT and the threshold voltage Vth of the driving transistor DT.

As thus, through twice precharge, that is, the current source Is outputs two different reference current signals, and the third acquisition capacitor C3 and the second acquisition capacitor C2 acquire the voltage VN1 of the node N1 and the voltage VN2 of the node N2 twice. In this way, two equations in regard to the carrier mobility μ of the driving transistor DT and the threshold voltage Vth of the driving transistor DT may be obtained. Based on the simultaneous equations, the carrier mobility μ of the driving transistor DT and the threshold voltage Vth of the driving transistor DT may be worked out.

In another aspect, the voltage VN2 of the node N2 is acquired by the second acquisition capacitor C2, and the light emitting current is the known reference current signal outputted by the current source Is. Therefore, an I-V ratio of the light emitting diode OL may be correspondingly worked out. Further, a corresponding relationship among the display brightness, the light emitting current Ids and the anode voltage of the light emitting diode OL is determined.

By means of the above precharge phase P21 and the voltage acquisition phase P22, the carrier mobility μ of the driving transistor DT, the threshold voltage Vth of the driving transistor DT, and the corresponding relationship between the light emitting current and brightness of the current light emitting diode OL may be worked out, so as to obtain the compensated data voltage signal by compensating the data voltage signal. Specifically, when it is expected that a light emitting diode within a certain pixel region displays certain brightness, a numerical value of the light emitting current may be determined according to the corresponding relationship between the display brightness and the light emitting current, and then the light emitting current Ids, the μ, the Vth, the Cox and the W/L are substitute into the above Formula (1). In this way, the numerical value of the Vgs may be obtained by an inverse solution. Additionally, Vgs=Vdata−Vs, the Vs may be obtained by means of a volt-ampere characteristic curve (namely, the I-V ratio) of the light emitting diode OL, and finally the compensated numerical value of the Vdata may be obtained.

Next, in a data writing phase P23, the first control signal terminal S1 and the second control signal terminal S2 input a low voltage level signal, and the fourth control signal terminal S4 and the fifth control signal terminal S5 input a high voltage level signal. The compensated data voltage signal is supplied to the gate of the driving transistor DT via the data voltage signal line Vdata, and the reference voltage signal is supplied to the anode of the light emitting diode OL via the fourth transistor T4 through the reference voltage signal line Vref.

Finally, in a light emission phase P24, the first control signal terminal S1, the fourth control signal terminal S4 and the fifth control signal terminal S5 input a low voltage level signal, the second control signal terminal S2 inputs a high voltage level signal, and the light emitting diode OL emits light based on the compensated data voltage signal written into the gate of the driving transistor DT in the data writing phase P23.

As thus, the threshold voltage of the driving transistor DT, the carrier mobility and aging of the light emitting diode OL may be compensated by means of the pixel compensation circuit 410, thereby ensuring display brightness uniformity for the organic light emitting display panel in time dimension and space dimension.

Specifically, the pixel compensation circuit 410 of this embodiment compensates the threshold voltage of the driving transistor DT and the carrier mobility, which may avoid a problem that the display brightness obtained by providing the same data voltage signal to these driving transistors may be different due to difference in the threshold voltage of the driving transistor and the carrier mobility resulted from distinction of manufacturing processes, thereby implementing display brightness uniformity in space (namely, in different regions of the panel).

In another aspect, the pixel compensation circuit 410 of this embodiment also compensates aging of the light emitting diode OL, which avoids a problem that the brightness is lower and lower as time goes on when the light emitting diode OL receives the same anode voltage, thereby implementing display brightness uniformity in time dimension.

In some optional implementations, the organic light emitting display panel of this embodiment may further comprise an integrated circuit (not shown in the figure). The first end of the third acquisition capacitor C3 is electrically connected with the integrated circuit, and the first end of the second acquisition capacitor C2 is electrically connected with the integrated circuit. As thus, the third acquisition capacitor C3 may transmit the acquired voltage of the node N1 to the integrated circuit, and the second acquisition capacitor C2 also may transmit the acquired voltage of the node N2 to the integrated circuit. The integrated circuit may determine the threshold voltage of the driving transistor DT, the carrier mobility and the I-V ratio of the light emitting diode according to the acquired voltage signal.

In these optional implementations, for example, the numerical value of Vdata corresponding to each level of brightness may be stored in a memory of the integrated circuit. When a certain level of brightness needs to be displayed, the integrated circuit may read the numerical value of data voltage corresponding to the brightness in the memory, and provide the numerical value of data voltage to a corresponding pixel driving circuit.

Figure 6:
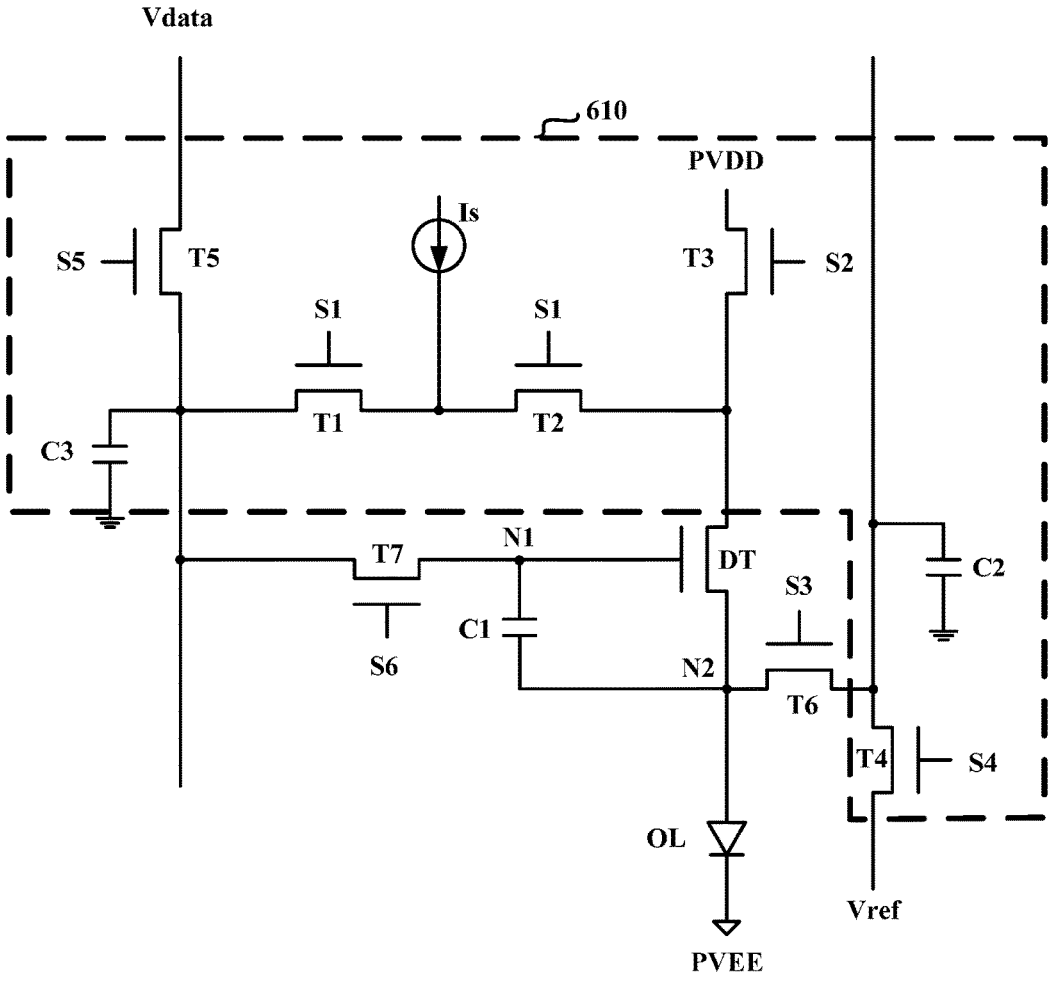
FIG. 6 illustrates a schematic diagram of a connection relationship between a pixel driving circuit and a pixel compensation circuit in an organic light emitting display panel according to still another embodiment of the present disclosure.

Referring to FIG. 6, which illustrates a schematic diagram of a connection relationship between a pixel driving circuit and a pixel compensation circuit in an organic light emitting display panel according to another embodiment of the present disclosure.

Similar to FIG. 4, in this embodiment, the pixel driving circuit likewise comprises the driving transistor DT, the light emitting diode OL and the first capacitor C1. The pixel compensation circuit likewise comprises the current source Is, the first transistor T1, the second transistor T2, the third transistor T3, the fourth transistor T4, the fifth transistor T5, the second acquisition capacitor C2 and the third acquisition capacitor C3. The connection relationship among these components is similar to the embodiment as shown in FIG. 4.

Different from the embodiment as shown in FIG. 4, in this embodiment, the pixel driving circuit may further comprise a sixth transistor T6 and a seventh transistor T7.

A gate of the sixth transistor T6 is electrically connected with a third control signal terminal S3, a first electrode of the sixth transistor T6 is electrically connected with the anode of the light emitting diode OL, and a second electrode of the sixth transistor T6 is electrically connected with a reference voltage signal line Vref.

A gate of the seventh transistor T7 is electrically connected with a sixth control signal terminal S6, a first electrode of the seventh transistor T7 is electrically connected with the second electrode of the first transistor T1, and a second electrode of the seventh transistor T7 is electrically connected with the gate of the driving transistor DT.

As thus, each pixel driving circuit corresponding to a column of pixel regions is electrically connected with the same pixel compensation circuit, so that the same pixel compensation circuit may compensate, based on time sharing, the threshold voltage of the driving transistor in each pixel driving circuit of the same column of pixel regions, the carrier mobility and aging of the light emitting diode.

Figure 7:
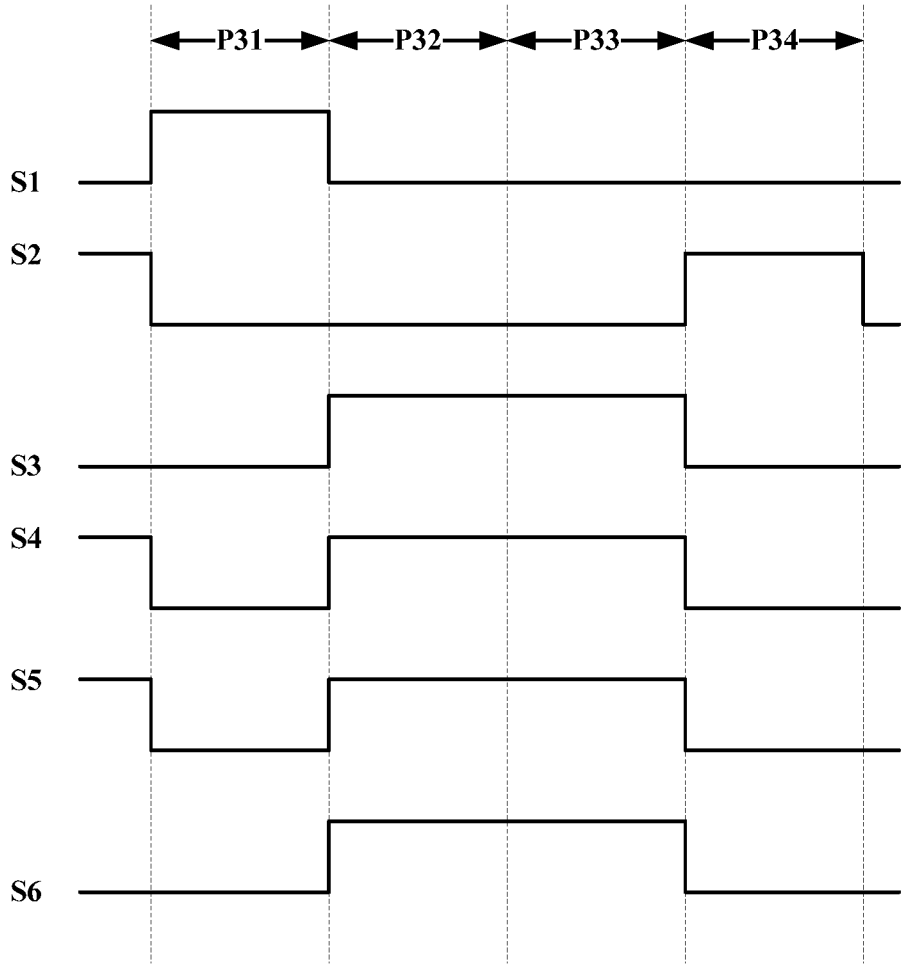
FIG. 7 illustrates a schematic timing sequence of each drive signal used in FIG. 6.

In the following, the working principle of the pixel compensation circuit in this embodiment will be further described with reference to the timing diagram as shown in FIG. 7. In the following description, a description is schematically made taking each transistor in FIG. 6 as an NMOS transistor.

Specifically, in a precharge phase P31, the first control signal terminal S1, the third control signal terminal S3 and the sixth control signal terminal S6 input a high voltage level signal, and the second control signal terminal S2, the fourth control signal terminal S4 and the fifth control signal terminal S5 input a low voltage level signal. At this moment, the first transistor T1, the second transistor T2, the sixth transistor T6 and the seventh transistor T7 are turned on, the current source Is outputs a known reference current signal and supplies the reference current signal to the gate of the driving transistor DT and the anode of the light emitting diode OL. After stabilization, no current flows through the gate of the driving transistor DT. At this moment, the reference current signal outputted by the current source Is totally flows to the anode of the light emitting diode OL. Meanwhile, the third acquisition capacitor C3 may acquire and store the voltage VN1 of the node N1. The second acquisition capacitor C2 may acquire and store the voltage VN2 of the node N2 because the sixth transistor T6 is turned on.

Next, in a voltage acquisition phase P32, the first control signal terminal S1, the second control signal terminal S2, the third control signal terminal S3 and the sixth control signal terminal S6 input a low voltage level signal, and the fourth control signal terminal S4 and the fifth control signal terminal S5 input a high voltage level signal. At this moment, the fourth transistor T4 and the fifth transistor T5 are turned on. As thus, the voltage VN1 of the node N1 stored in the third acquisition capacitor C3 in the precharge phase P31 may be acquired via a data line Vdata, and the voltage VN2 of the node N2 stored in the second acquisition capacitor C2 in the precharge phase P31 may be acquired via the reference voltage signal line Vref.

When the driving transistor DT is in a saturation region, current Ids may be determined according to the above Formula (1). In the precharge phase, the current outputted by the current source Is is a known quantity, in the above Formula (1), Ids, Cox, and Vgs=VN1−VN2 are known. Unknown quantities comprise the carrier mobility μ of the driving transistor DT and the threshold voltage Vth of the driving transistor DT.

As thus, through twice precharge, that is, the current source Is outputs two different reference current signals, and the third acquisition capacitor C3 and the second acquisition capacitor C2 acquire the voltage VN1 of the node N1 and the voltage VN2 of the node N2 twice. In this way, two equations in regard to the carrier mobility μ of the driving transistor DT and the threshold voltage Vth of the driving transistor DT may be obtained. Based on the simultaneous equations, the carrier mobility μ of the driving transistor DT and the threshold voltage Vth of the driving transistor DT may be worked out.

In another aspect, the voltage VN2 of the node N2 is acquired by the second acquisition capacitor C2, and the light emitting current is the known reference current signal outputted by the current source Is. Therefore, an I-V ratio of the light emitting diode OL may be correspondingly worked out. Further, a corresponding relationship among the display brightness, the light emitting current Ids and the anode voltage of the light emitting diode OL is determined.

By means of the above precharge phase P31 and the voltage acquisition phase P32, the carrier mobility μ of the driving transistor DT, the threshold voltage Vth of the driving transistor DT, and the corresponding relationship between the light emitting current and brightness of the current light emitting diode OL may be worked out, so as to obtain the compensated data voltage signal by compensating the data voltage signal. Specifically, when it is expected that a light emitting diode within a certain pixel region displays certain brightness, a numerical value of the light emitting current may be determined according to the corresponding relationship between the display brightness and the light emitting current, and then the light emitting current Ids, the p, the Vth, the Cox and the W/L are substitute into the above Formula (1). In this way, the numerical value of the Vgs may be obtained by an inverse solution. Additionally, Vgs=Vdata−Vs, the Vs may be obtained by means of a volt-ampere characteristic curve (namely, the I-V ratio) of the light emitting diode OL may be obtained via the Vs, and finally the compensated numerical value of the Vdata may be obtained.

Next, in a data writing phase P33, the first control signal terminal S1 and the second control signal terminal S2 input a low voltage level signal, and the third control signal terminal S3, the fourth control signal terminal S4, the fifth control signal terminal S5 and the sixth control signal terminal S6 input a high voltage level signal. The compensated data voltage signal is supplied to the gate of the driving transistor DT via the seventh transistor T7 through the data voltage signal line Vdata, and the reference voltage signal is supplied to the anode of the light emitting diode OL via the sixth transistor T6 through the reference voltage signal line Vref.

Finally, in a light emission phase P34, the first control signal terminal S1, the third control signal terminal S3, the fourth control signal terminal S4, the fifth control signal terminal S5 and the sixth control signal terminal S6 input a low voltage level signal, the second control signal terminal S2 inputs a high voltage level signal, and the light emitting diode OL emits light based on the compensated data voltage signal written into the gate of the driving transistor DT in the data writing phase P33.

As thus, the threshold voltage of the driving transistor DT, the carrier mobility and aging of the light emitting diode OL may be compensated by means of the pixel compensation circuit 610, thereby ensuring display brightness uniformity for the organic light emitting display panel in time dimension and space dimension.

Specifically, the pixel compensation circuit 610 of this embodiment compensates the threshold voltage of the driving transistor DT and the carrier mobility, which may avoid a problem that the display brightness obtained by providing the same data voltage signal to these driving transistors may be different due to difference in the threshold voltage of the driving transistor and the carrier mobility resulted from distinction of manufacturing processes, thereby implementing display brightness uniformity in space (namely, in different regions of the panel).

In another aspect, the pixel compensation circuit 610 of this embodiment also compensates aging of the light emitting diode OL, which avoids a problem that the brightness is lower and lower as time goes on when the light emitting diode OL receives the same anode voltage, thereby implementing display brightness uniformity in time dimension.

It is to be noted that in this embodiment, not only the driving time sequence as shown in FIG. 7 may be used for driving, but also the driving time sequence as shown in FIG. 3 or FIG. 5 may be used for driving. When the driving time sequence as shown in FIG. 3 or FIG. 5 is used for driving, for example, transistors not enabled in the driving process may be correspondingly disconnected according to needs for the driving time sequence.

Figure 8:
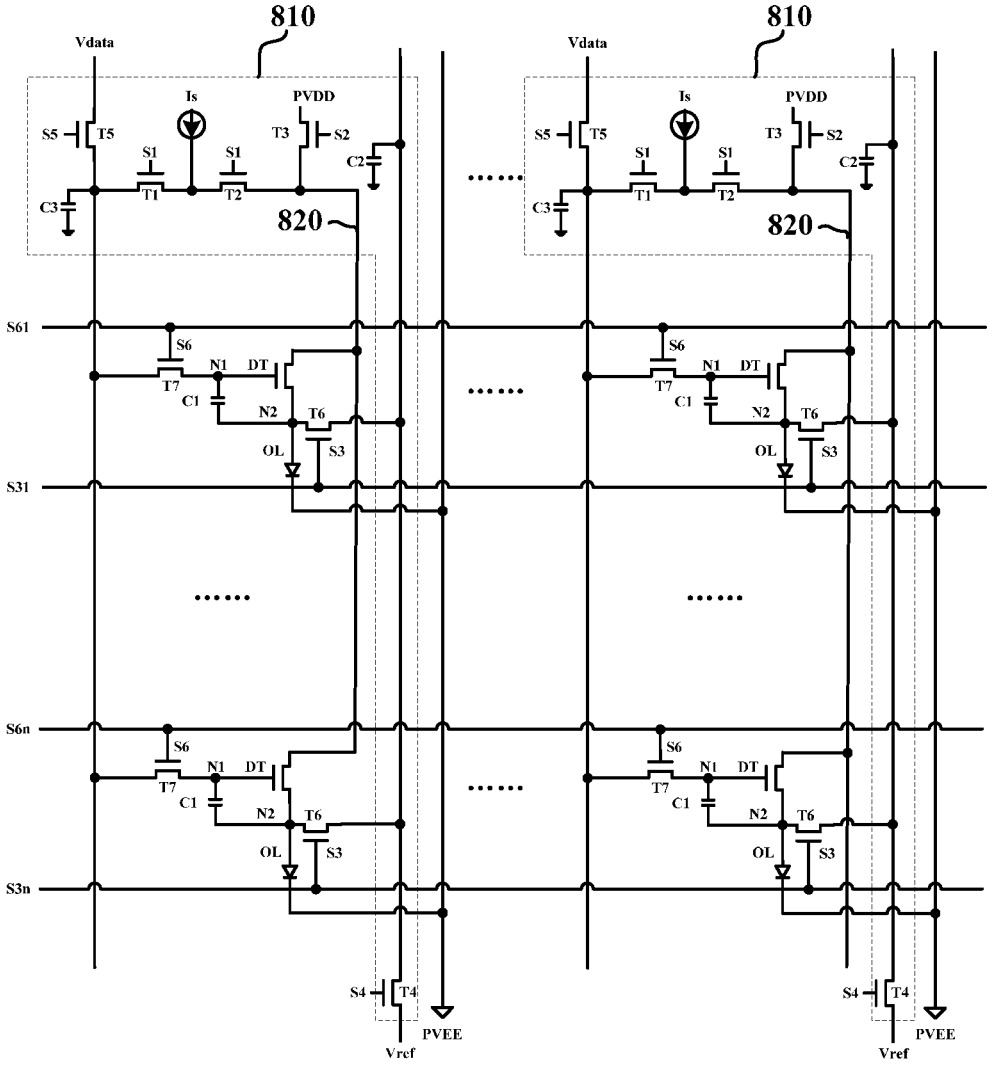
FIG. 8 illustrates a schematic structural diagram of an organic light emitting display panel according to another embodiment of the present disclosure.

Referring to FIG. 8, which is a schematic structural diagram of an organic light emitting display panel according to another embodiment of the present disclosure.

Similar to the organic light emitting display panel as shown in FIG. 1, the organic light emitting display panel of this embodiment likewise comprises a pixel array, a plurality of pixel driving circuits and a plurality of pixel compensation circuits 810.

Different from the embodiment as shown in FIG. 1, in the organic light emitting display panel of this embodiment, each pixel compensation circuit 810 is configured to acquire the anode voltage of the light emitting diode in each pixel driving circuit corresponding to the same column of pixel regions and the light emitting current flowing through the light emitting diode. That is, in the pixel array, each pixel driving circuit 810 in a certain column of pixel regions is electrically connected with the same pixel compensation circuit.

As thus, each pixel compensation circuit 810 may acquire, based on time sharing, the anode voltage of the light emitting diode in each pixel driving circuit electrically connected with the pixel compensation circuit 810 and the light emitting current flowing through the light emitting diode. When calculating a compensation signal, for example, the compensation signal may be respectively calculated for the driving transistor and the light emitting diode in each pixel region. Alternatively, an average value of the threshold voltages of the same column of driving transistors may be calculated and determined as the common threshold voltage of the column of driving transistors, and a common brightness-current curve of the column of light emitting diodes may be determined by synthesizing the brightness-current curves of the column of light emitting diodes.

By electrically connecting the same column of pixel driving circuits to the same pixel compensation circuit 810, the number of the pixel compensation circuits 810 may be reduced as much as possible under the premise of ensuring a pixel compensation effect, thereby reducing a layout area of the pixel compensation circuit 810 occupying the organic light emitting display panel. In another aspect, the pixel compensation circuit 810 generally is arranged in a non-display area of the organic light emitting display panel, and thus space occupied by the non-display area may be reduced, which is advantageous to implementation of narrow bezel of the organic light emitting display panel.

In addition, in some optional implementations, as shown in FIG. 8, the organic light emitting display panel of this embodiment further comprises a plurality of first voltage signal lines 820. Each first voltage signal line 820 is electrically connected with the first voltage signal terminal PVDD. Each pixel driving circuit corresponding to a column of pixel regions is electrically connected with the same first voltage signal line 820. By electrically connecting the same column of pixel driving circuits to the same first voltage signal line 820, the number of lines of the organic light emitting display panel may be further reduced, thereby reducing mutual interference among the lines and lifting a transmission speed of each signal line in transmitting a signal.

In addition, in some optional implementations, as shown in FIG. 8, each pixel driving circuit corresponding to a row of pixel regions is electrically connected with the same third control signal terminal, and each pixel driving circuit corresponding to a row of pixel regions is electrically connected with the same sixth control signal terminal.

For example, in FIG. 8, each pixel driving circuit corresponding to a first row of pixel regions is electrically connected with the same third control signal terminal S31, and each pixel driving circuit corresponding to a first row of pixel regions is electrically connected with the same sixth control signal terminal S61. Similarly, each pixel driving circuit corresponding to the $n^{th}$ row of pixel regions is electrically connected with the same third control signal terminal S3*n*, and each pixel driving circuit corresponding to the $n^{th}$ row of pixel regions is electrically connected with the same sixth control signal terminal S6*n*.

As thus, each pixel driving circuit in the same row of pixel regions may synchronously work, thereby implementing a row of pixels being lighted synchronously to emit light.

Further, when the same row of third control signal terminals S3 and sixth control signal terminals S6 output the same waveform (for example, when the driving time sequence as shown in FIG. 7 is adopted), in the same row of pixel regions, gates of the sixth transistor T6 and the seventh transistor T7 of each pixel driving circuit may share the same signal terminal, thereby reducing the number of drive signals required for the organic light emitting display panel and reducing the mutual interference among drive signal terminals.

Figure 9:
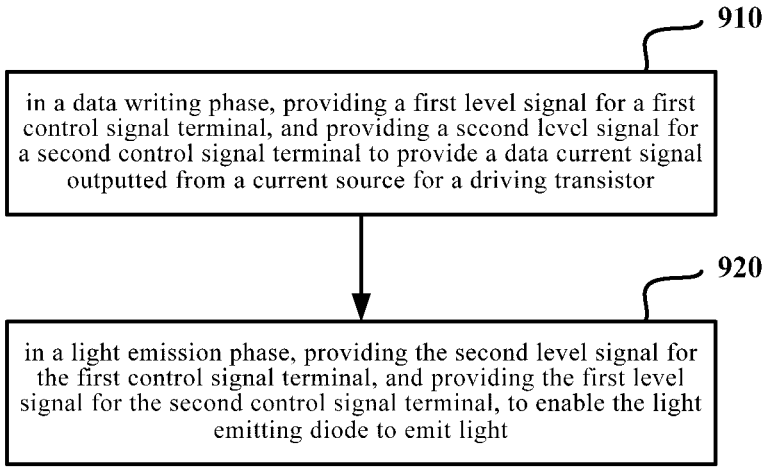
FIG. 9 illustrates a schematic flowchart of a driving method according to an embodiment of the present disclosure.

Referring to FIG. 9, FIG. 7 is a schematic flowchart of a driving method according to an embodiment of this application. The driving method of this embodiment may be applied to the organic light emitting display panel as described in any one of the above embodiments.

The driving method of this embodiment comprises following steps.

Step 910: in a data writing phase, providing a first voltage level signal for a first control signal terminal, and providing a second voltage level signal for a second control signal terminal to provide a data current signal outputted by a current source for a driving transistor.

Step 920: in a light emission phase, providing the second voltage level signal for the first control signal terminal, and providing the first voltage level signal for the second control signal terminal to allow the light emitting diode to emit light.

As thus, as long as the current source Is supplies light emitting current corresponding to each display gray scale to each pixel driving circuit via the pixel compensation circuit, the light emitting diode OL in each pixel driving circuit may be ensured to emit light of corresponding brightness, and the light emitting brightness may be merely related to the magnitude of the light emitting current supplied by the current source but unrelated to the threshold voltage of the driving transistor DT, the carrier mobility and the aging degree of the light emitting diode OL (namely, the I-V ratio of the light emitting diode OL). Therefore, no matter how the threshold voltage of each driving transistor DT in the organic light emitting display panel and the carrier mobility vary, and no matter what the aging degree of each light emitting diode OL in the organic light emitting display panel is, by using the circuit driving method of this embodiment, uniform display of each display brightness in each region of the organic light emitting display panel may be implemented, thereby enhancing the display brightness uniformity for the organic light emitting display panel.

Figure 10:
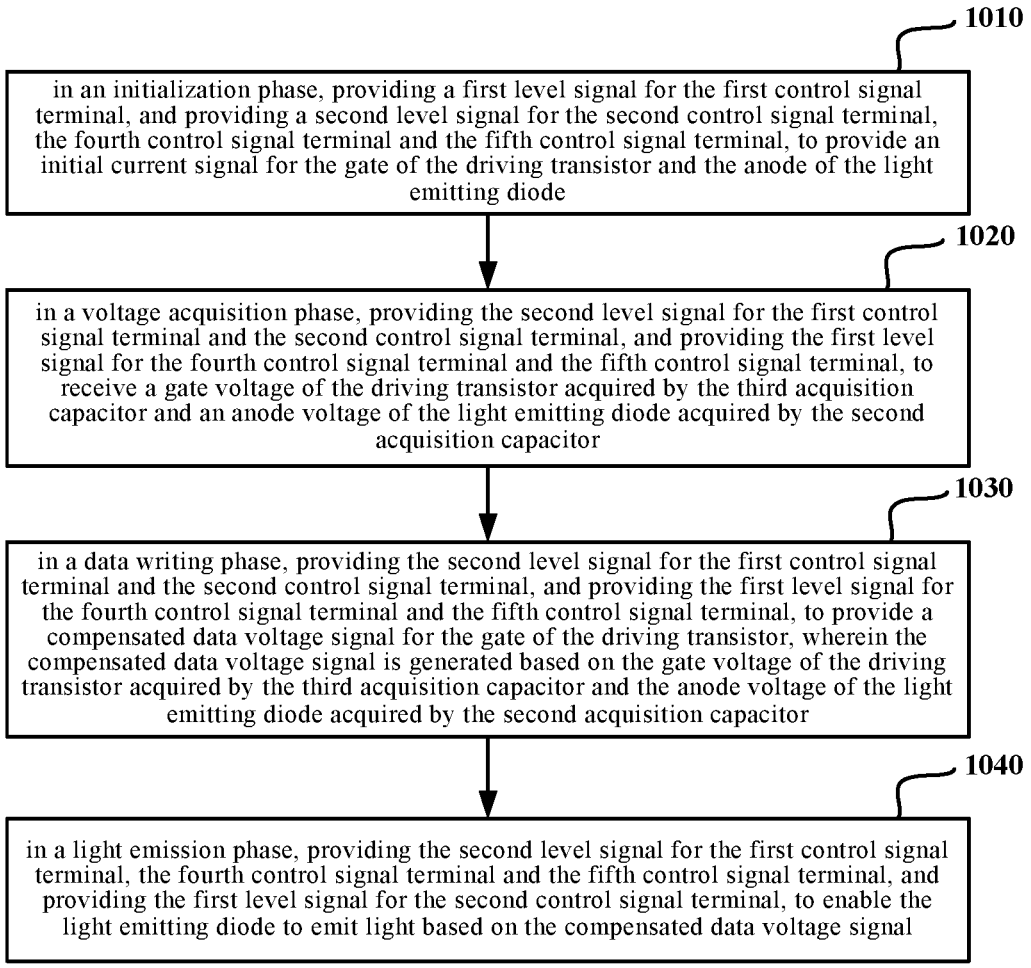
FIG. 10 illustrates a schematic flowchart of a driving method according to another embodiment of the present disclosure.

Referring to FIG. 10, which is a schematic flowchart of a method for driving an organic light emitting display panel according to another embodiment of the present disclosure. The driving method of this embodiment may be used for driving the organic light emitting display panel having the pixel driving circuit and the pixel compensation circuit as shown in FIG. 4.

The driving method of this embodiment comprises following steps.

Step 1010: in an initialization phase, providing a first voltage level signal for the first control signal terminal, and providing a second level signal for the second control signal terminal, the fourth control signal terminal and the fifth control signal terminal to provide an initial current signal for the gate of the driving transistor and the anode of the light emitting diode.

Step 1020: in a voltage acquisition phase, providing the second level signal for the first control signal terminal and the second control signal terminal, and providing the first level signal for the fourth control signal terminal and the fifth control signal terminal to receive a gate voltage of the driving transistor acquired by the third acquisition capacitor and an anode voltage of the light emitting diode acquired by the second acquisition capacitor.

Step 1030: in a data writing phase, providing the second level signal for the first control signal terminal and the second control signal terminal, and providing the first level signal for the fourth control signal terminal and the fifth control signal terminal to provide a compensated data voltage signal for the gate of the driving transistor, wherein the compensated data voltage signal is generated based on the gate voltage of the driving transistor acquired by the third acquisition capacitor and the anode voltage of the light emitting diode acquired by the second acquisition capacitor.

Step 1040: in a light emission phase, providing the second level signal for the first control signal terminal, the fourth control signal terminal and the fifth control signal terminal, and providing the first level signal for the second control signal terminal to allow the light emitting diode to emit light based on the compensated data voltage signal.

As thus, as can be seen from the structure as shown in FIG. 4, the current source Is of the pixel compensation circuit 410 may output a reference current signal to the node N1 and the node N2 of the pixel driving circuit. The voltage of the node N1 is acquired by the third acquisition capacitor C3, and the voltage of the node N2 is acquired by the second acquisition capacitor C2. A certain numerical relationship exists among the light emitting current, the difference Vgs between the gate voltage (namely, the voltage of the node N1) and the source voltage (namely, the voltage of the node N2) of the driving transistor DT, the carrier mobility of the driving transistor DT and the threshold voltage of the driving transistor DT, and the reference current signal outputted by the current source Is is a known numerical value. Therefore, by repeatedly acquiring the voltage of the node N1 and the voltage of the node N2, the carrier mobility and the threshold voltage of the driving transistor DT may be determined correspondingly. Meanwhile, the I (flow current)-V (anode voltage) ratio of the light emitting diode OL may be worked out by means of the voltage of the node N2 and the reference current signal outputted by the current source Is.

As can be seen from the above analysis, after the driving method of this embodiment is adopted, by acquiring the gate voltage (the voltage of the node N1) of the driving transistor DT and the anode voltage (the voltage of the node N2) of the light emitting diode OL, the pixel compensation circuit 410 may determine the current carrier mobility and the threshold voltage of the driving transistor DT and the I-V ratio of the light emitting diode OL in the pixel driving circuit in the event that the light emitting current (namely, the reference current outputted by the current source Is) flowing through the light emitting diode OL is known. As thus, a compensation signal may be determined according to the gate voltage (the voltage of the node N1) of the driving transistor DT, the anode voltage of the light emitting diode OL and the known light emitting current (namely, the reference current outputted by the current source Is) flowing through the light emitting diode OL. When a data voltage signal is applied to each pixel driving circuit, the data voltage signal applied to each pixel driving circuit is compensated by using the compensation signal, so as to enhance the display brightness uniformity for the whole organic light emitting display panel.

In addition, in some optional implementations, the driving method of this embodiment also may be used for driving the organic light emitting display panel having the pixel driving circuit and the pixel compensation circuit as shown in FIG. 6.

In these optional implementations, Step 1010 of this embodiment may further comprise: in an initialization phase, providing the first level signal for the third control signal terminal and the sixth control signal terminal.

Step 1020 of this embodiment may further comprise: in the voltage acquisition phase, providing the second level signal for the third control signal terminal and the sixth control signal terminal.

Step 1030 of this embodiment may further comprise: in the data writing phase, providing the first level signal for the third control signal terminal and the sixth control signal terminal.

Step 1040 of this embodiment may further comprise: in the light emission phase, providing the second level signal for the third control signal terminal and the sixth control signal terminal.

As thus, by providing a data voltage signal compensated by a compensation signal to the gate of the driving transistor in each pixel driving circuit, compensation of the threshold voltage of the driving transistor, the carrier mobility and aging of the light emitting diode may be implemented, thereby ensuring display brightness uniformity for the organic light emitting display panel in time dimension and space dimension.

Figure 11:
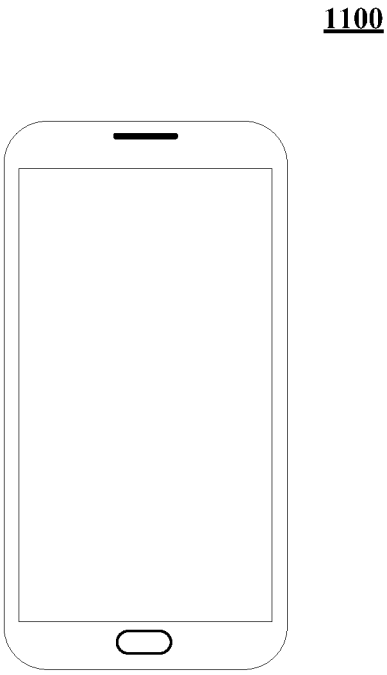
FIG. 11 illustrates a schematic structural diagram of an organic light emitting display apparatus according to the present disclosure.

The present disclosure further provides an organic light emitting display apparatus, as shown in FIG. 11, the organic light emitting display apparatus 1100 comprises the organic light emitting display panel according to the foregoing embodiments, which may be a mobile phone, a tablet computer and a wearable device, etc. It is to be understood that the organic light emitting display apparatus 1100 may further comprise known structures such as an encapsulation film and protective glass, which is not unnecessarily described herein.

The organic light emitting display panel disclosed in each embodiment of the present disclosure not only may be applied to a top-emitting organic light emitting display apparatus, but also may be applied to a bottom-emitting organic light emitting display apparatus. Therefore, the organic light emitting display apparatus of the present disclosure may be a top-emitting organic light emitting display apparatus or a bottom-emitting organic light emitting display apparatus.

It should be appreciated by those skilled in the art that the inventive scope of the present disclosure is not limited to the technical solutions formed by the particular combinations of the above technical features. The inventive scope should also cover other technical solutions formed by any combinations of the above technical features or equivalent features thereof without departing from the concept of the invention, such as, technical solutions formed by replacing the features as disclosed in the present disclosure with (but not limited to), technical features with similar functions.

What is claimed is:

1. An organic light emitting display panel, comprising:

a pixel array, comprising pixel regions in M rows and N columns;

a plurality of pixel driving circuits each comprising a light emitting diode and a driving transistor for driving the light emitting diode, the light emitting diode being arranged in each of the pixel regions; and a plurality of pixel compensation circuits, each configured to provide a compensating light emitting control signal for a gate of the driving transistor to correct brightness of the light emitting diode in one of the plurality of pixel driving circuits;

wherein the plurality of pixel compensation circuits each comprises a current source, a first transistor, a second transistor and a third transistor;

wherein a gate of the first transistor and a gate of the second transistor are electrically connected with a first control signal terminal, a first electrode of the first transistor and a first electrode of the second transistor are electrically connected with an output terminal of the current source, a second electrode of the first transistor is electrically connected with the gate of the driving transistor, and a second electrode of the second transistor is electrically connected with a second electrode of the third transistor;

a gate of the third transistor is electrically connected with a second control signal terminal, a first electrode of the third transistor is electrically connected with a first voltage signal terminal, and a second electrode of the third transistor is electrically connected with a first electrode of the driving transistor; and the said pixel driving circuit further comprises a first capacitor, a first end of the first capacitor is electrically connected with the gate of the driving transistor, and a second end of the first capacitor is electrically connected with a second electrode of the driving transistor and an anode of the light emitting diode.

2. The organic light emitting display panel according to claim 1, wherein the said pixel compensation circuit further comprises a second acquisition capacitor, a third acquisition capacitor, a fourth transistor and a fifth transistor;

wherein a first end of the third acquisition capacitor is electrically connected with the second electrode of the first transistor, and a second end of the third acquisition capacitor is grounded;

wherein a gate of the fourth transistor is electrically connected with a fourth control signal terminal, a first electrode of the fourth transistor is electrically connected with a first end of the second acquisition capacitor, a second electrode of the fourth transistor is electrically connected with a reference voltage signal line, and a second end of the second acquisition capacitor is grounded; and wherein a gate of the fifth transistor is electrically connected with a fifth control signal terminal, a first electrode of the fifth transistor is electrically connected with a data line, and a second electrode of the fifth transistor is electrically connected with the second electrode of the first transistor.

3. The organic light emitting display panel according to claim 2, further comprising an integrated circuit;

wherein the first end of the second acquisition capacitor is electrically connected with the integrated circuit, and the first end of the third acquisition capacitor is electrically connected with the integrated circuit.

4. The organic light emitting display panel according to claim 1, wherein the pixel driving circuit further comprises a sixth transistor and a seventh transistor;

wherein a gate of the sixth transistor is electrically connected with a third control signal terminal, a first electrode of the sixth transistor is electrically connected with the anode of the light emitting diode, and a second electrode of the sixth transistor is electrically connected with a reference voltage signal line; and wherein a gate of the seventh transistor is electrically connected with a sixth control signal terminal, a first electrode of the seventh transistor is electrically connected with the second electrode of the first transistor, and a second electrode of the seventh transistor is electrically connected with the gate of the driving transistor.

5. The organic light emitting display panel according to claim 4, wherein the pixel driving circuits corresponding to the pixel regions in a column are electrically connected with one of the plurality of pixel compensation circuits associated with the said column.

6. The organic light emitting display panel according to claim 5, further comprising a plurality of first voltage signal lines electrically connected with the first voltage signal terminal;

wherein the pixel driving circuits corresponding to the pixel regions in the given column are electrically connected with the first voltage signal line associated with the given column.

7. The organic light emitting display panel according to claim 5, wherein the pixel driving circuits corresponding to the pixel regions in one of the M rows are electrically connected with the third control signal terminal, and the pixel driving circuits corresponding to the pixel regions in the given row are electrically connected with the sixth control signal terminal.

8. A method for driving an organic light emitting display panel, applicable to drive the organic light emitting display panel according to claim 1, wherein the method comprises:

in a data writing phase, providing a first level signal for the first control signal terminal, and providing a second level signal for the second control signal terminal to output a data current signal from the current source for the driving transistor; and in a light emission phase, providing the second level signal for the first control signal terminal, and providing the first level signal for the second control signal terminal, to enable the light emitting diode to emit light.

9. A method for driving the organic light emitting display panel according to claim 1, wherein the pixel compensation circuit further comprises a second acquisition capacitor, a third acquisition capacitor, a fourth transistor and a fifth transistor;

wherein a first end of the third acquisition capacitor is electrically connected with the second electrode of the first transistor, and a second end of the third acquisition capacitor is grounded;

wherein a gate of the fourth transistor is electrically connected with a fourth control signal terminal, a first electrode of the fourth transistor is electrically connected with a first end of the second acquisition capacitor, a second electrode of the fourth transistor is electrically connected with a reference voltage signal line;

wherein a gate of the fifth transistor is electrically connected with a fifth control signal terminal, a first electrode of the fifth transistor is electrically connected with a data line, and a second electrode of the fifth transistor is electrically connected with the second electrode of the first transistor;

wherein the method comprises:

in an initialization phase, providing a first level signal for the first control signal terminal, and providing a second level signal for the second control signal terminal, the fourth control signal terminal and the fifth control signal terminal, to provide an initial current signal for the gate of the driving transistor and the anode of the light emitting diode;

in a voltage acquisition phase, providing the second level signal for the first control signal terminal and the second control signal terminal, and providing the first level signal for the fourth control signal terminal and the fifth control signal terminal, to receive a gate voltage of the driving transistor acquired by the third acquisition capacitor and an anode voltage of the light emitting diode acquired by the second acquisition capacitor;

in a data writing phase, providing the second level signal for the first control signal terminal and the second control signal terminal, and providing the first level signal for the fourth control signal terminal and the fifth control signal terminal, to provide a compensated data voltage signal for the gate of the driving transistor, wherein the compensated data voltage signal is generated based on the gate voltage of the driving transistor acquired by the third acquisition capacitor and the anode voltage of the light emitting diode acquired by the second acquisition capacitor; and in a light emission phase, providing the second level signal for the first control signal terminal, the fourth control signal terminal and the fifth control signal terminal, and providing the first level signal for the second control signal terminal, to enable the light emitting diode to emit light based on the compensated data voltage signal.

10. The method according to claim 9, wherein the pixel driving circuit of the organic light emitting display panel further comprises a sixth transistor and a seventh transistor;

wherein a gate of the sixth transistor is electrically connected with a third control signal terminal, a first electrode of the sixth transistor is electrically connected with the anode of the light emitting diode, and a second electrode of the sixth transistor is electrically connected with a reference voltage signal line;

wherein a gate of the seventh transistor is electrically connected with a sixth control signal terminal, a first electrode of the seventh transistor is electrically connected with the second electrode of the first transistor, and a second electrode of the seventh transistor is electrically connected with the gate of the driving transistor;

wherein the method further comprises:

in the initialization phase, providing the first level signal for the third control signal terminal and the sixth control signal terminal;

in the voltage acquisition phase, providing the second level signal for the third control signal terminal and the sixth control signal terminal;

in the data writing phase, providing the first level signal for the third control signal terminal and the sixth control signal terminal; and in the light emission phase, providing the second level signal for the third control signal terminal and the sixth control signal terminal.

11. An organic light emitting display apparatus, comprising the organic light emitting display panel according to claim 1.

* * * * *